US009215523B2

(12) United States Patent
Kitatani et al.

(10) Patent No.: US 9,215,523 B2
(45) Date of Patent: Dec. 15, 2015

(54) AUDIO OUTPUT DEVICE

(75) Inventors: Kenichi Kitatani, Kanagawa (JP); Ayumu Yagihashi, Kanagawa (JP); Hiroyuki Aoki, Kanagawa (JP); Yumi Katou, Kanagawa (JP); Atsuhiko Murayama, Kanagawa (JP); Seiji Sugahara, Tokyo (JP)

(73) Assignee: NEC CORPORATION, Tokyo (JP)

( * ) Notice: Subject to any disclaimer, the term of this patent is extended or adjusted under 35 U.S.C. 154(b) by 19 days.

(21) Appl. No.: 13/981,034

(22) PCT Filed: Jan. 24, 2012

(86) PCT No.: PCT/JP2012/000435

§ 371 (c)(1),
(2), (4) Date: Jul. 22, 2013

(87) PCT Pub. No.: WO2012/105183

PCT Pub. Date: Aug. 9, 2012

(65) Prior Publication Data

US 2013/0294637 A1 Nov. 7, 2013

(30) Foreign Application Priority Data

Feb. 2, 2011 (JP) ..... 2011-020330

(51) Int. Cl.
*H04R 1/02* (2006.01)
*H04R 1/32* (2006.01)
(Continued)

(52) U.S. Cl.
CPC ..... *H04R 1/323* (2013.01); *H01H 13/84* (2013.01); *H04S 7/30* (2013.01); *H01H 2215/03* (2013.01);
(Continued)

(58) Field of Classification Search
CPC ..... H04R 1/323; H04R 2499/11; H04R 2499/15; H04R 2217/03; H01H 13/84; H04S 7/30; H04S 1/00
USPC ..... 381/300, 387, 306–311; 345/156, 170, 345/168, 179, 173, 183; 715/727, 728, 257; 455/569.1, 575.1
See application file for complete search history.

(56) References Cited

U.S. PATENT DOCUMENTS

| | | | | |
|---|---|---|---|---|
| 2003/0197687 | A1 * | 10/2003 | Shetter | 345/173 |
| 2010/0214267 | A1 * | 8/2010 | Radivojevic et al. | 345/175 |
| 2011/0205161 | A1 * | 8/2011 | Myers et al. | 345/169 |
| 2011/0211035 | A1 | 9/2011 | Ota et al. | |

FOREIGN PATENT DOCUMENTS

| | | | |
|---|---|---|---|
| CN | 101120511 | A | 2/2008 |
| EP | 1035732 | A1 * | 9/2000 |

(Continued)

OTHER PUBLICATIONS

Office Action dated Jul. 1, 2014, issued by the Japanese Patent Office, in counterpart Application No. 2011020330.

(Continued)

*Primary Examiner* — Sunita Joshi
(74) *Attorney, Agent, or Firm* — Sughrue Mion, PLLC

(57) ABSTRACT

A portable terminal device (100) includes a plurality of operation units (for example, a plurality of operation keys (11)) that are operated by a user; a detection unit that detects which operation unit of the plurality of operation units is operated; and a directional speaker (for example, a parametric speaker (30)). The portable terminal device (100) further includes an audio control unit that controls the directional speaker so that an audio image is formed at a position corresponding to the position of the operation unit operated by the user among the plurality of operation units.

7 Claims, 12 Drawing Sheets

(51) Int. Cl.

| | |
|---|---|
| ***H04S 7/00*** | (2006.01) |
| ***H01H 13/84*** | (2006.01) |
| *H04R 5/02* | (2006.01) |
| *H04S 1/00* | (2006.01) |

(52) U.S. Cl.
CPC ..... *H04R 2203/12* (2013.01); *H04R 2217/03* (2013.01); *H04R 2499/11* (2013.01); *H04R 2499/13* (2013.01); *H04R 2499/15* (2013.01); *H04S 1/00* (2013.01); *H04S 2400/11* (2013.01)

(56) References Cited

FOREIGN PATENT DOCUMENTS

| | | | | |
|---|---|---|---|---|
| JP | 3264883 | A | | 11/1991 |
| JP | 2000-082162 | A | | 3/2000 |
| JP | 2000-285709 | A | | 10/2000 |
| JP | 2005319952 | A | | 11/2005 |
| JP | 2007-158638 | A | | 6/2007 |
| JP | 2007158638 | A | * | 6/2007 |
| JP | 2007-274061 | A | | 10/2007 |
| JP | 201041167 | A | | 2/2010 |
| JP | 2010-068023 | A | | 3/2010 |
| WO | 00/18112 | A1 | | 3/2000 |

OTHER PUBLICATIONS

Communication dated Dec. 24, 2014, issued by the State Intellectual Property Office of the People's Republic of China in counterpart Application No. 201280007355.2.

Communication dated Jan. 8, 2015 from the European Patent Office in counterpart European Application No. 12742510.6.

* cited by examiner

AUDIO OUTPUT DEVICE

CROSS REFERENCE TO RELATED APPLICATIONS

This application is a National Stage of International Application No. PCT/JP2012/000435filed Jan. 24, 2012, claiming priority based on Japanese Patent Application No. 2011-020330, filed Feb. 2, 2011, the contents of all of which are incorporated herein by reference in their entirety.

TECHNICAL FIELD

The present invention relates to an audio output device.

BACKGROUND ART

A parametric speaker is also called a directional speaker, and the like, and has a feature that the directionality of an audio to be output is high. For this reason, an audio image (acoustic field) can be selectively formed in a specific region by using the parametric speaker.

For example, Patent Document 1 discloses a technique in which an audio image is constantly located at a predetermined position using a parametric speaker.

In addition, Patent Document 2 discloses a technique in which an audio image is located at a position of an object in an image using a parametric speaker.

RELATED DOCUMENT

Patent Document

[Patent Document 1] Japanese Unexamined Patent Publication No. 2010-68023

[Patent Document 2] Japanese Unexamined Patent Publication No. 2007-274061

DISCLOSURE OF THE INVENTION

Incidentally, in a general audio output device, when an audio is output in association with a user's operation, the audio is just output with a constant directionality from a speaker.

In addition, even in the technique of Patent Document 2, an audio image is just located at a position of an object in an image.

An object of the invention is to provide an audio output device capable of associating the position of an operation unit which is operated by a user with a direction in which an audio is heard.

The invention provides an audio output device including: a plurality of operation units that are operated by a user; a detection unit that detects which operation unit of the plurality of operation units is operated; a directional speaker; and an audio control unit that controls the directional speaker so that an audio image is formed at a position corresponding to the position of the operation unit that is operated by the user among the plurality of operation units.

According to the invention, a direction in which an audio is heard can be associated with a position of an operation unit operated by a user.

BRIEF DESCRIPTION OF THE DRAWINGS

The above-described objects, other objects, features and advantages will be further apparent from the preferred embodiments described below, and the accompanying drawings as follows.

DESCRIPTION OF EMBODIMENTS

Figure 1:
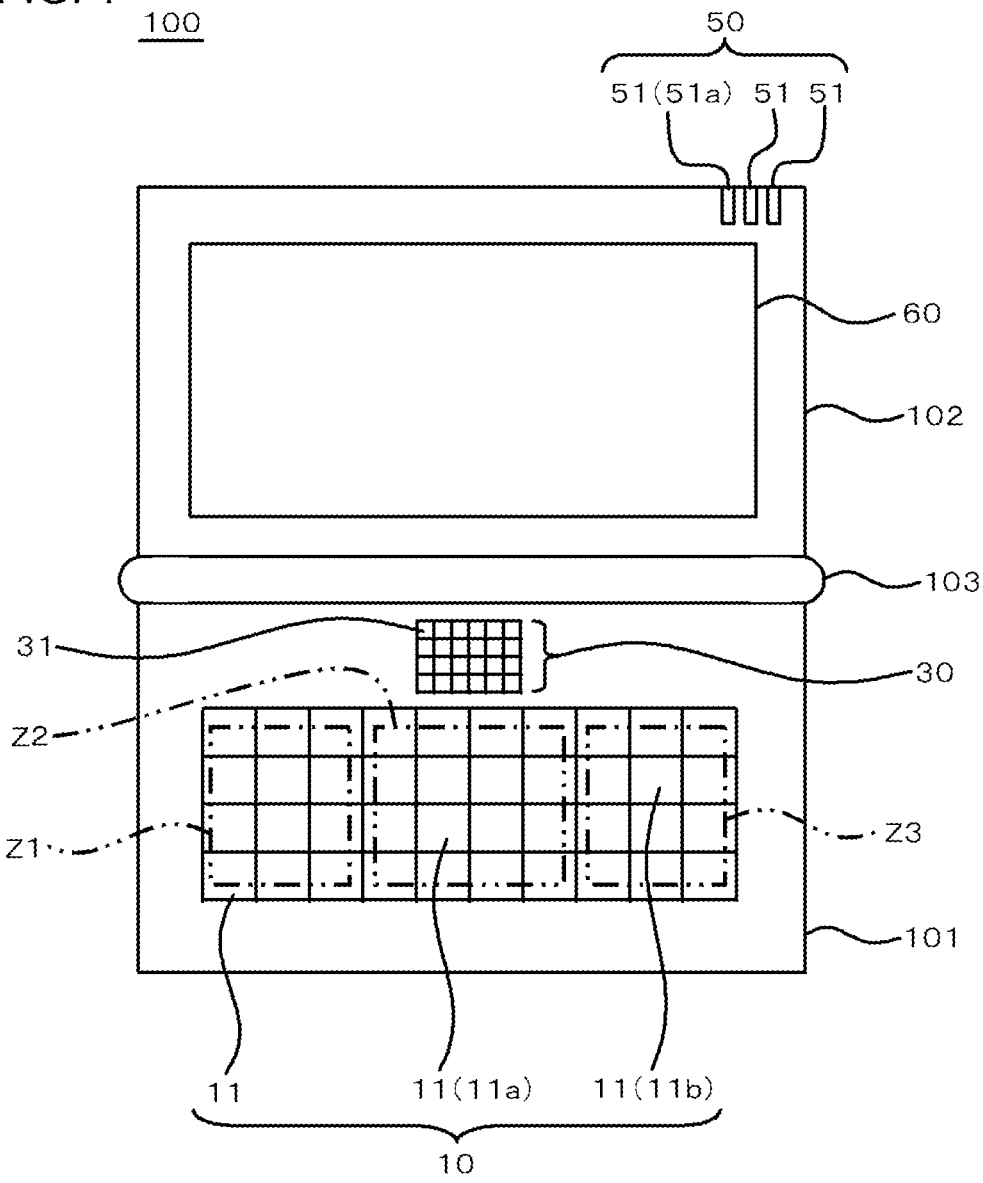
FIG. 1 is a front view illustrating a portable terminal device as an audio output device according to a first embodiment.

Hereinafter, embodiments of the invention will be described in detail with reference to the accompanying drawings. Meanwhile, throughout the drawings, same reference numerals refer to like elements, and the description thereof will not be repeated.

[First Embodimen]

Figure 2:
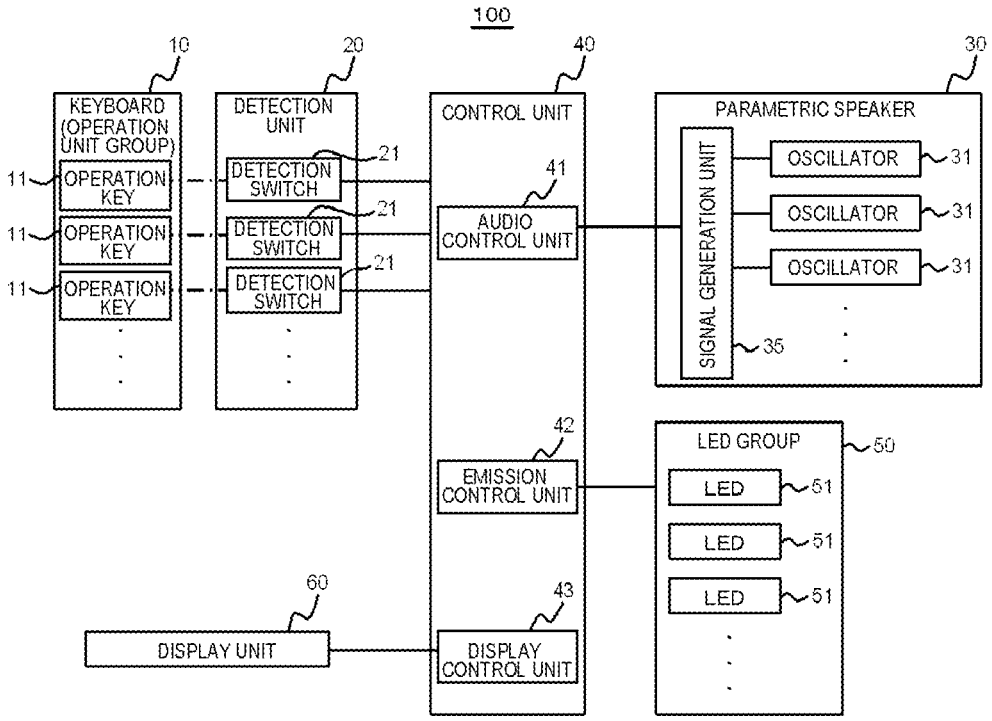
FIG. 2 is a block diagram illustrating the portable terminal device of FIG. 1.

FIG. 1 is a front view illustrating a portable terminal device 100 as an audio output device according to a first embodiment. FIG. 2 is a block diagram illustrating the portable terminal device 100 of FIG. 1.

The portable terminal device 100 according to the embodiment includes a plurality of operation units (for example, a plurality of operation keys 11) that are operated by a user, a detection unit 20 that detects which operation unit of the plurality of operations has been operated, a directional speaker (for example, a parametric speaker 30), and an audio control unit 41 that controls the directional speaker so that an audio image is formed at a position corresponding to the position of the operation unit operated by the user, among the plurality of operation units. Meanwhile, the portable terminal device is, for example, a cellular phone, a PDA (Personal Digital Assistant), a small game machine, or a laptop personal computer, which will be described below in detail.

As shown in FIG. 1, the portable terminal device 100 includes a keyboard (operation unit group) 10 having the plurality of operation keys 11, and the parametric speaker 30.

The plurality of operation keys 11 each receives an input of an operation when being pressed by a user, and are arranged, for example, in a matrix.

For example, the parametric speaker 30 includes a plurality of oscillators 31 each oscillating ultrasonic waves and arranged in an array. The oscillators 31 are arranged, for example, in a matrix. Further, the parametric speaker 30 generates an electrical signal to be input to each oscillator 31. The parametric speaker 30 is disposed, for example, in the vicinity of the keyboard 10.

The portable terminal device 100 further includes an LED group (light-emitting member group) 50 having a plurality of LEDs (light-emitting members) 51, and a display unit 60 constituted by a liquid crystal display device or the like.

The portable terminal device 100 includes, for example, first and second housings 101 and 102, and a hinge unit 103 that connects the first and second housings 101 and 102 to each other so as to be openable and closable.

For example, the keyboard 10 and the parametric speaker 30 are provided in the first housing 101, and the LED group 50 and the display unit 60 are provided in the second housing 102. The keyboard 10, the parametric speaker 30, the LED group 50, and the display unit 60 are all disposed in a surface serving as an inner side when the first and second housings 101 and 102 are closed.

The LED group 50 is disposed in the vicinity (for example, upper right) of a region in which the display unit 60 is disposed, and includes the plurality of (for example, three) LEDs 51, for example, arranged horizontally in a line.

As shown in FIG. 2, the portable terminal device 100 further includes the detection unit 20 and a control unit 40 in addition to the keyboard 10, the parametric speaker 30, the LED group 50, and the display unit 60.

For example, the detection unit 20 includes the same number of detection switches 21 as the operation keys 11. When each of the detection switches 21 detects the operation for the corresponding operation key 11, the detection switch 21 outputs a signal indicating the detection (hereinafter, detection signal) to the control unit 40.

The control unit 40 includes an audio control unit 41 that individually controls operations of the oscillators 31 of the parametric speaker 30, an emission control unit 42 that individually controls operations of the LEDs 51 of the LED group 50, and a display control unit 43 that controls operations of the display unit 60.

The oscillators 31 of the parametric speaker 30 are controlled by the audio control unit 41, thereby allowing an audio image to be formed in a desired region. In other words, the audio image can be located in the desired region.

More specifically, the audio control unit 41 controls the oscillators 31 so that an audio image is formed at a position (for example, above the operation key 11) corresponding to the position of the operation key 11 that is operated by a user among the plurality of operation keys 11. In other words, for example, when an operation key 11*a* (FIG. 1) is operated, the audio image is formed above the operation key 11*a*. In addition, when an operation key 11*b* (FIG. 1) is operated, the audio image is formed above the operation key 11*b*.

Figure 3:
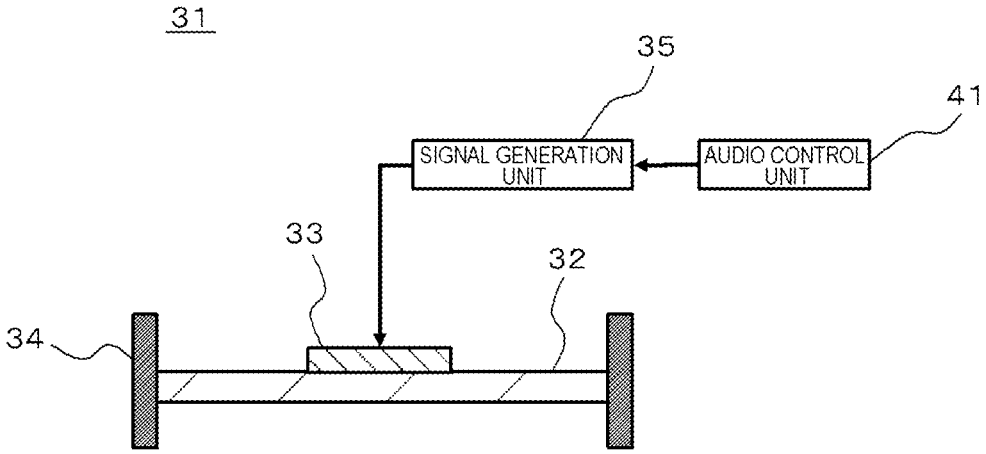
FIG. 3 is a schematic diagram illustrating an oscillator included in the portable terminal device of FIG. 1.

FIG. 3 is a schematic diagram illustrating the oscillator 31.

The oscillator 31 includes, for example, a sheet-shaped vibration member 32, a vibrator 33, and a supporting member 34. The vibrator 33 is, for example, a piezoelectric vibrator, and is attached to one surface of the vibration member 32. The supporting member 34 supports an edge of the vibration member 32. For example, the supporting member 34 is fixed to a circuit board (not shown) or a housing of the portable terminal device 100.

The signal generation unit 35 and the audio control unit 41 constitute an oscillation circuit that oscillates acoustic waves from the vibrator 33 and the vibration member 32 by inputting an oscillation signal to the vibrator 33 to vibrate the vibrator 33.

The vibration member 32 vibrates by vibration generated from the vibrator 33, and oscillates acoustic waves, for example, having a frequency equal to or greater than 20 kHz. Meanwhile, the vibrator 33 also oscillates acoustic waves, for example, having a frequency equal to or greater than 20 kHz by its own vibration. In addition, the vibration member 32 adjusts a fundamental resonance frequency of the vibrator 33. A fundamental resonance frequency of a mechanical vibrator depends on load weight and compliance. Since the compliance is mechanical rigidity of the vibrator, the fundamental resonance frequency of the vibrator 33 can be controlled by controlling the rigidity of the vibration member 32. Meanwhile, the thickness of the vibration member 32 is preferably equal to or greater than 5 μm and equal to or less than 500 μm. In addition, it is preferable that the vibration member 32 have a longitudinal elastic modulus, which is an index indicating rigidity, equal to or greater than 1 Gpa and equal to or less than 500 GPa. When the rigidity of the vibration member 32 is excessively low or high, there is a possibility that characteristics and reliability as a mechanical vibrator may be damaged. Meanwhile, the material for forming the vibration member 32 is not particularly limited as long as it is a material, such as a metal or a resin, having a high elastic modulus with respect to the vibrator 33 which is formed of a brittle material, but is preferably phosphor bronze, stainless steel or the like from the viewpoint of workability or costs.

In the embodiment, a planar shape of the vibrator 33 is a circular shape. However, the planar shape of the vibrator 33 is not limited to the circular shape. The entirety of a surface of the vibrator 33 which faces the vibration member 32 is fixed to the vibration member 32 using an adhesive agent. Accordingly, the entirety of the single-sided surface of the vibrator 33 is restrained by the vibration member 32.

The signal generation unit 35 generates an electrical signal to be input to the vibrator 33, that is, a modulation signal in the oscillator 31. Carrier waves of the modulation signal are, for example, ultrasonic waves having a frequency equal to or greater than 20 kHz, and specifically are, for example, ultrasonic waves having a frequency of 100 kHz. The audio control unit 41 controls the signal generation unit 35 in response to an audio signal to be input from the outside.

Figure 4:
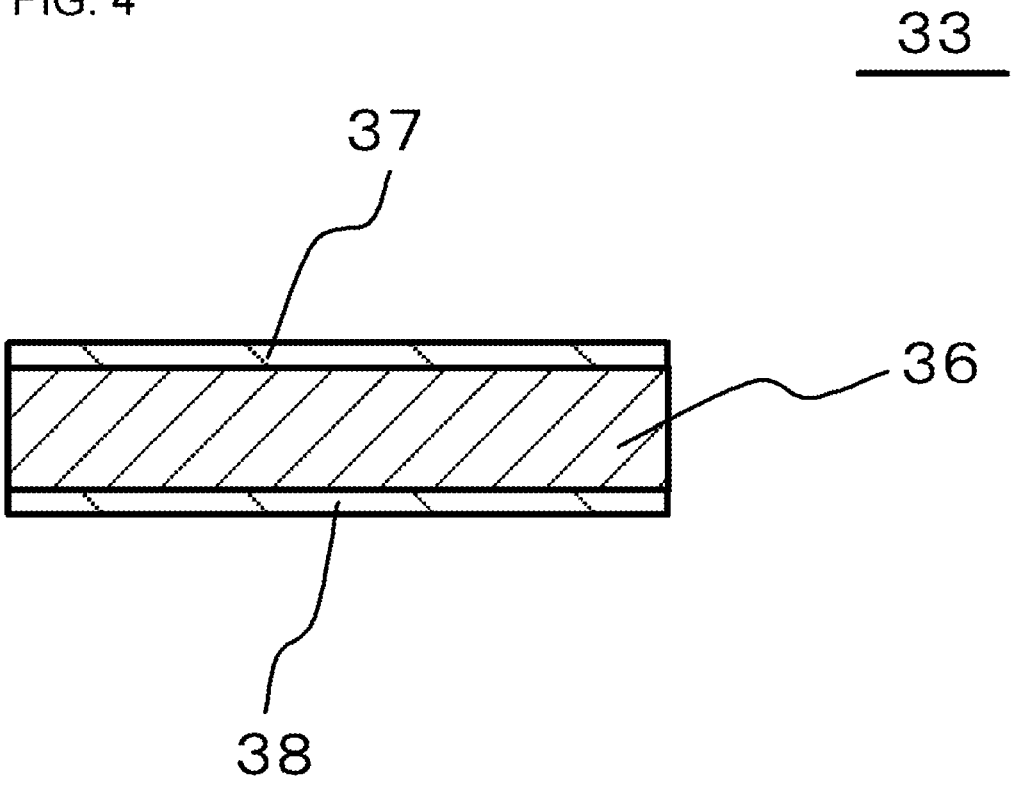
FIG. 4 is a cross-sectional view illustrating a layered structure of a vibrator.

FIG. 4 is a cross-sectional view illustrating a layered structure in the thickness direction of the vibrator 33. The vibrator 33 includes a piezoelectric body 36, an upper electrode 37, and a lower electrode 38.

The piezoelectric body 36 is polarized in the thickness direction. The material for forming the piezoelectric body 36 may be any of an inorganic material or an organic material as long as it is a material having a piezoelectric effect. However, the material is preferably a material having a high electromechanical conversion efficiency, for example, lead zirconate titanate (PZT) or barium titanate ($BaTiO_3$). A thickness h1 of the piezoelectric body 36 is, for example, equal to or greater than 10 μm and equal to or less than 1 mm. When the thickness h1 is less than 10 μm, there is a possibility that the vibrator 33 may be damaged during the manufacturing of the oscillator 31. In addition, when the thickness h1 exceeds 1 mm, there is a possibility that the electro-mechanical conversion efficiency is excessively lowered, and thus a sufficiently large vibration cannot be obtained. The reason is because when the thickness of the vibrator 33 increases, the electric field intensity within the piezoelectric vibrator is inversely proportional thereto and thus decreases.

Although the materials for forming the upper electrode 37 and the lower electrode 38 are not particularly limited, for example, silver or silver/palladium can be used. Since silver is used as a low-resistance versatile electrode material, there is an advantage in a manufacturing process, cost and the like. Since silver/palladium is a low-resistance material excellent in oxidation resistance, there is an advantage from the viewpoint of reliability. In addition, a thickness h2 of the upper electrode 37 and the lower electrode 38 is not particularly limited, but the thickness h2 is preferably equal to or greater than 1 μm and equal to or less than 50 μm. In the thickness h2 of less than 1 μm, it is difficult to uniformly form the upper electrode 37 and the lower electrode 38. As a result, there is a possibility that the electro-mechanical conversion efficiency decreases. In addition, when the film thicknesses of the upper electrode 37 and the lower electrode 38 exceed 100 μm, the upper electrode 37 and the lower electrode 38 serve as constraint surfaces with respect to the piezoelectric body 36, and thus there is a possibility that the energy conversion efficiency may decrease.

The vibrator 33 can be set to have an outer diameter of ϕ18 mm, an inner diameter of ϕ12 mm, and a thickness of 100 μm. In addition, as the upper electrode 37 and the lower electrode 38, for example, a silver/palladium alloy (having a weight ratio of, for example, 7:3) having a thickness of 8 μm can be used. In addition, as the vibration member 32, phosphor bronze having an outer diameter of ϕ20 mm and a thickness of 50 μm (0.3 mm) can be used. The supporting member 34 serve as a case of the oscillator 31, and is formed, for example, in a tubular shape (for example, cylindrical shape) having an outer diameter of ϕ22 mm and an inner diameter of ϕ20 mm.

The parametric speaker 30 emits ultrasonic waves (carrier waves) on which an AM modulation, a DSB modulation, an SSB modulation, or an FM modulation is performed from each of the plurality of oscillators 31 into the air, and issues an audible sound based on the non-linear characteristics when ultrasonic waves are propagated into the air. The term "non-linear" herein indicates a transition from a laminar flow to a turbulent flow when the Reynolds number expressed by the ratio of the inertial action and the viscous action of a flow increases. Since the acoustic wave is very slightly disturbed within a fluid, the acoustic wave is propagated non-linearly. Particularly, in the ultrasonic wave frequency band, the non-linearity of the acoustic wave can be easily observed. When the ultrasonic waves are emitted into the air, higher harmonic waves associated with the non-linearity of the acoustic wave are conspicuously generated. In addition, the acoustic wave is in a sparse and dense state in which light and shade occur in the molecular density in the air. When it takes time for air molecules to be restored rather than compressed, the air which is not capable of being restored after the compression collides with air molecules continuously propagated, and thus a shock wave occurs. The audible sound is generated, that is, reproduced (demodulated) due to the shock wave. The parametric speaker 30 has an advantage that the directionality of an audio is high.

Hereinafter, a series of operations will be described.

Figure 5:
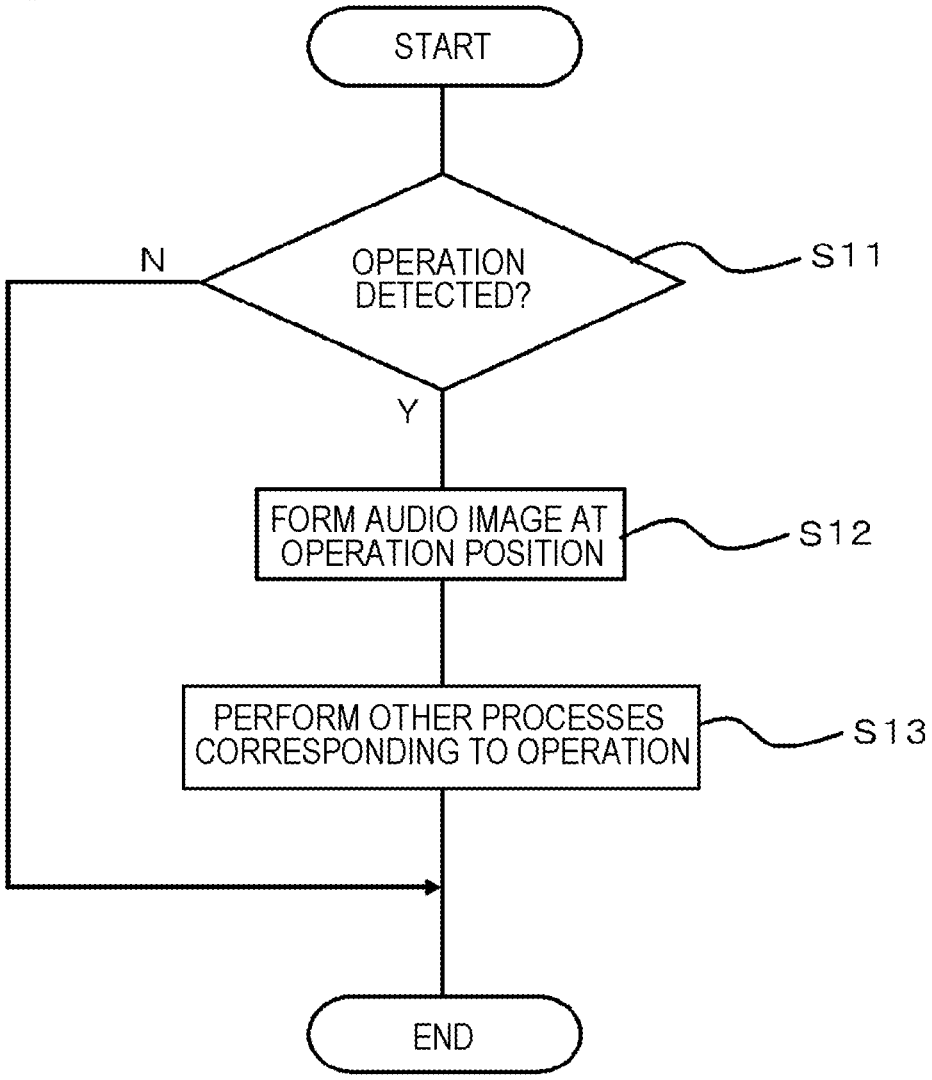
FIG. 5 is a flow chart illustrating a flow of operations according to the first embodiment.

FIG. 5 is a flow chart illustrating a flow of operations performed by the control unit 40 according to the first embodiment.

First, a user operates any one operation key 11 (for example, operation key 11*a*) of the plurality of operation keys 11. Then, the control unit 40 recognizes the operation of the operation key 11*a* using the detection signal that is input from the detection switch 21 corresponding to the operation key 11*a* (Y of step S11).

Next, the audio control unit 41 of the control unit 40 controls the parametric speaker 30 so that an audio image is formed at a position corresponding to the position of the operation key 11*a*, for example, above the operation key 11*a*, that is, so that the audible sound is demodulated at that position. For example, the phase of the ultrasonic waves output from each oscillator 31 is controlled, thereby controlling the directionality of the parametric speaker 30 and adjusting the position of the audio image.

As a result, the audio image is located above the operation key 11 (for example, operation key 11*a*) that is operated by the user (step S12).

Thus, the user hears an audio (operation sound) from the position (direction) of the operation key 11 operated by the user at a timing when the user operates the operation key 11. Therefore, a novel operational sensation that the position at which the operation sound is heard is associated with the position of the operation key 11, can be obtained.

In order to implement such operations, for example, the audio control unit 41 store the value of the phase of the ultrasonic waves output from each oscillator 31 (or value of relative deviation amount of phase of ultrasonic waves output from each oscillator 31) for each of the operation key 11 as a table in advance. The audio control unit 41 extracts the value corresponding to the operated operation key 11 from the table, and controls the phase of each oscillator 31 based on the value.

Meanwhile, the table may, for example, be divided into a first table for determining the position at which the audio image is to be formed in an X coordinate (first direction parallel to display screen) and a second table for determining the position at which the audio image is to be formed in a Y coordinate (direction that is parallel to display screen and perpendicular to the first direction).

In addition, the audios reproduced in step S12 is, for example, a simple audio (for example, blip or the like) to cause the user to recognize the operation of the operation key 11, and may be a common audio for each of the operation keys 11.

Alternatively, the audios reproduced in step S12 may be different from each other for the operation keys 11. In other words, the audio control unit 41 may control the parametric speaker 30 so that the audio corresponding to the operation key 11 operated by the user is output. The audios different from each other for the operation keys 11 may be, for example, the same audios as the pronunciation of characters associated with the operation keys 11. Specifically, for example, in the case of the operation key 11 corresponding to a character "a", an audio "a" may be output.

In addition, in step S12, a resolution of the position at which the audio image is located can be appropriately changed corresponding to a resolution (depending on the number of oscillators 31, or the like) that can be implemented by the parametric speaker 30. When a fine resolution capable of forming the audio image at different positions according to the operation keys 11 is obtained, the audio image can be formed at different positions according to each of the operation keys 11.

Alternatively, when the position of the audio image cannot be controlled very finely, the audio image may be located in each of zones (for example, three zones of Z1, Z2, and Z3 shown in FIG. 1) by setting the region in which the plurality of operation keys 11 united into one group are disposed as one zone. In other words, the audio image may be located in the zone Z1 when any one operation key 11 included in the zone Z1 is operated, the audio image may be located in the zone Z2 when any one operation key 11 included in the zone Z2 is operated, and the audio image may be located in the zone Z3 when any one operation key 11 included in the zone Z3 is operated. Meanwhile, in this case, at least two zones are set.

In step S13 following step S12, other processes (processes other than the process in step S12) corresponding to the operation are performed. Specifically, for example, the emission control unit 42 controls the LEDs 51 to emit light in a predetermined emission mode (lighting, blinking, or the like), or the display control unit 43 controls the display unit 60 to display predetermined information, an image, or the like.

Meanwhile, when the operation is not performed (N of step S11), the forming of the audio image (step S12) and other processes (step S13) corresponding to the operation are not performed.

According to the above-described first embodiment, the detection unit 20 detects which operation key 11 of the plurality of operation keys 11 is operated by the user, and the audio control unit 41 controls the parametric speaker 30 so that the audio image is formed at a position corresponding to the position of the operation key 11 operated by the user, and thus a direction in which an audio is heard with respect to the user can be associated with the position of the operation key 11 operated by the user. Therefore, the operation position in the case where there are a plurality of operation keys 11 can also be confirmed not only through viewing or touching but also through hearing.

[Second Embodiment]

Figure 6:
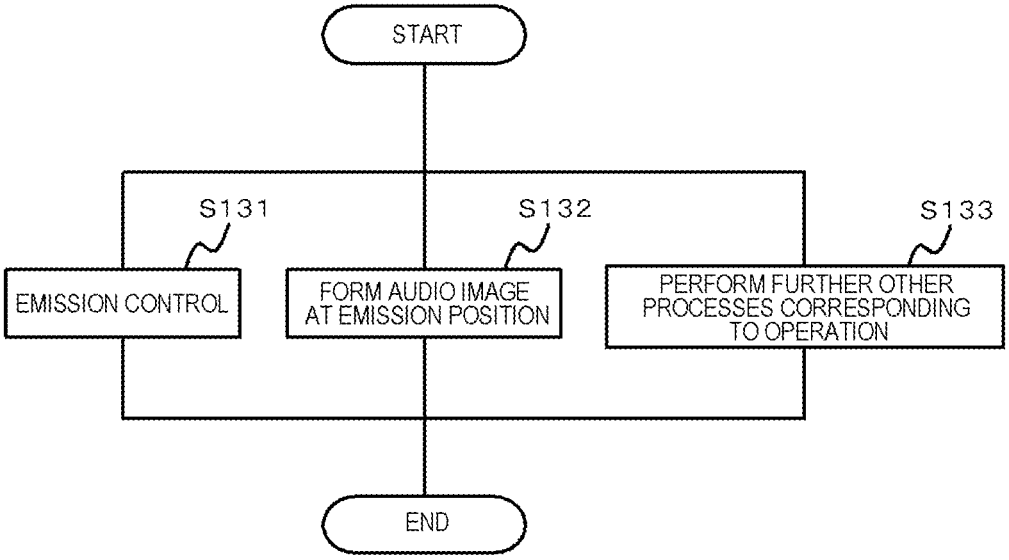
FIG. 6 is a flow chart illustrating a flow of operations according to a second embodiment.

FIG. 6 is a flow chart illustrating a flow of operations performed by the control unit 40 according to a second embodiment. FIG. 6 illustrates an example of a detailed process of step S13 (FIG. 5) described in the first embodiment. In the embodiment, a configuration of the portable terminal device 100 is as shown in FIGS. 1 and 2.

As described above, in step S13 of FIG. 5, a process corresponding to the operation (other than the process in step S12) is performed.

Specifically, for example, as shown in FIG. 6, while the emission control unit 42 performs emission control for causing the LEDs 51 to emit light in a predetermined emission mode (lighting, blinking, or the like) (step S131), the audio control unit 41 controls the parametric speaker 30 so that an audio image is formed at an emission position (step S132). The emission position refers to a position corresponding to the LED 51 that is emitting light by the emission control, among the plurality of LEDs 51, and the emission position is, for example, above the LED 51 that is emitting light. A manner of adjusting the position of the audio image is the same as that in step S12.

In addition, further other processes (for example, a process of causing the display control unit 43 to display predetermined information, an image, or the like on the display unit 60) corresponding to the operation are further performed in parallel with the processes of step S131 and step S132 or following these processes (step S133).

As such, in the second embodiment, the portable terminal device 100 includes the LEDs (light-emitting members) 51 and the emission control unit 42 that controls the LEDs 51. The audio control unit 41 controls the parametric speaker 30 so that the audio image is formed at a position corresponding to the position of the LED 51 in association (synchronization) with the emission operation of the LED 51.

For this reason, a user hears an audio from the position (direction) of the LED 51 emitting light at a timing when the LED 51 emits light. In other words, the direction in which the audio is heard with respect to the user can be associated with the position of the LED 51 emitting light. Therefore, a novel decoration through the emission and the audio can be implemented.

[Third Embodiment]

Figure 7:
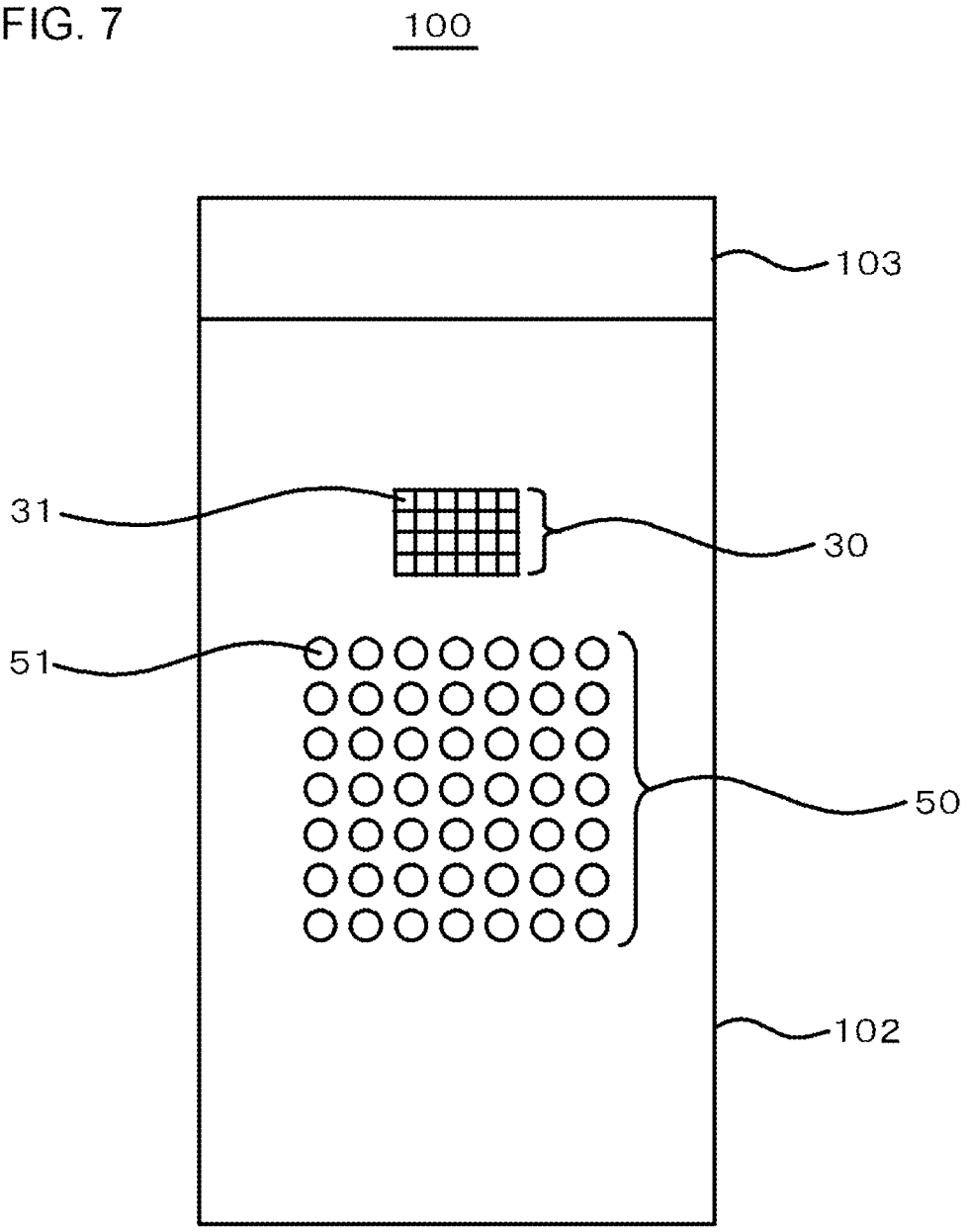
FIG. 7 is a front view illustrating a folded portable terminal device as an audio output device according to a third embodiment.

FIG. 7 is a front view illustrating a folded portable terminal device 100 as an audio output device according to a third embodiment. Meanwhile, even in the third embodiment, a block configuration of the portable terminal device 100 is the same as that of FIG. 2.

The structure of the portable terminal device 100 according to the embodiment is different from that of the portable terminal device 100 according to the second embodiment in the following respects.

First, while the plurality of LEDs 51 are arranged in a line in the second embodiment, the plurality of LEDs 51 are arranged in a matrix in the second embodiment. Specifically, for example, the LED group 50 includes a total of 49 LEDs 51 of 7 rows by 7 columns.

In addition, in the second embodiment, the LED group 50 and the parametric speaker 30 are disposed in a surface serving as an inner side when the first and second housings 101 and 102 are folded, while in the third embodiment, the LED group 50 and the parametric speaker 30 are disposed in a surface (for example, surface serving as the front side when the second housing 102 is placed on the front side) serving as an outer side when the first and second housings 101 and 102 are folded. In other words, in the embodiment, for example, the LED group 50 and the parametric speaker 30 are provided in the second housing 102.

However, even in the embodiment, separately from the LED group 50, another LED group (for example, the same one as the LED group 50 in the first embodiment) may also be provided in the surface serving as an inner side when the first and second housings 101 and 102 are folded.

Similarly, even in the embodiment, separately from the parametric speaker 30, another parametric speaker 30 (for example, the same one as the parametric speaker 30 in the first embodiment) may also be provided in the surface serving as the inner side when the first and second housings 101 and 102 are folded.

Meanwhile, the second embodiment shows the example in which the first and second housings 101 and 102 have a horizontally long shape, that is, a shape in which a turning radius of the first and second housings 101 and 102 when opening or closing the first and second housings 101 and 102 through the hinge unit 103 is shorter than the lengths of the first and second housings 101 and 102 in the axial direction (horizontal direction of FIG. 1) of the hinge unit 103.

On the other hand, in the third embodiment, for example, the first and second housings 101 and 102 have a vertically long shape, that is, a shape in which the turning radius of the first and second housings 101 and 102 is longer than the lengths of the first and second housings 101 and 102 in the axial direction (horizontal direction of FIG. 7) of the hinge unit 103.

In the embodiment, the audio control unit 41 controls the parametric speaker 30 so that an audio image is formed at a position corresponding to the position of the LED 51 emitting light among the plurality of LEDs 51 arranged in a matrix. Meanwhile, similarly to a case where the audio image is formed to correspond to the operation keys 11 (step S12 of FIG. 5), the audio image may be formed at a position corresponding to each LED 51, or the audio image may be formed in each zone including the plurality of LEDs 51.

In addition, for example, the emission control unit 42 performs a series of emission control operations for causing the plurality of LEDs 51 to emit light in a predetermined order (emission pattern), thereby allowing illumination to be implemented through the emission of the plurality of LEDs 51.

The audio control unit 41 controls the parametric speaker 30 so that the audio image is formed at a position corresponding to the position of the LED 51 emitting light in association (synchronization) with the emission control. Specifically, for example, when the emission control of the emission pattern in which the LED 51 emitting light moves is performed, it is possible to perform the control in which the position of the audio image moves with the movement of emitting light.

Meanwhile, for example, the control of the parametric speaker 30 which is associated with the above-described emission control can be performed when the first and second housings 101 and 102 are folded.

Alternatively, the portable terminal device 100 may be a portable terminal device having a communication function, for example, a cellular phone. In this case, the control of the parametric speaker 30 which is associated with the emission control can be performed when a call, an e-mail, or the like arrives.

According to the above-described third embodiment, a further complex and novel decoration than the second embodiment can be implemented through emission and audios.

[Fourth Embodiment]

Figure 8:
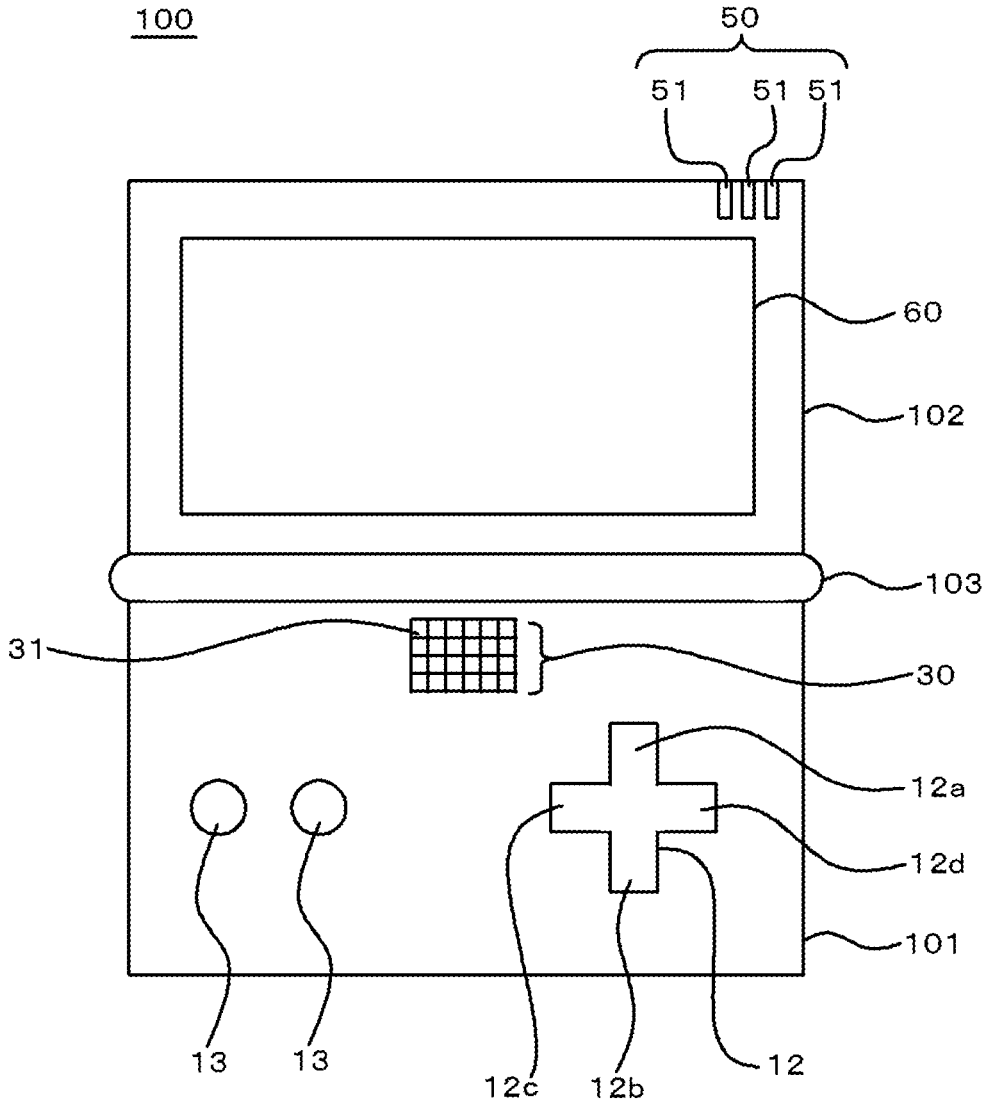
FIG. 8 is a front view illustrating a portable terminal device as an audio output device according to a fourth embodiment.

FIG. 8 is a front view illustrating a portable terminal device 100 as an audio output device according to a fourth embodiment. Although each of the above-described embodiments shows an example in which it is assumed that the operation units (operation keys 11) are individually formed and operated by being individually pressed, a plurality of operation units (for example, four operation units of 12*a*, 12*b*, 12*c*, and 12*d*) may be integrally formed, for example, like cross key 12 shown in FIG. 8. Like the general cross key 12, for example, the operation unit 12*a*, the operation unit 12*b*, the operation unit 12*c*, and the operation unit 12*d* can be respectively used for an operation for instructing movement upward, an operation for instructing movement downward, an operation for instructing movement leftward, and an operation for instructing movement rightward. In addition, the portable terminal device 100 is not limited to the operation key 11 of the keyboard 10 (FIG. 1), and may include other operation buttons 13 (FIG. 8).

In the embodiment, when the operation units 12*a* to 12*d* of the cross key 12 are operated, an audio image can be formed at a position corresponding to each of the operated operation units 12*a* to 12*d*. Alternatively, when any one operation button 13 is operated, the audio image can be formed at a position corresponding to the operated operation button 13.

[Fifth Embodiment]

Figure 9:
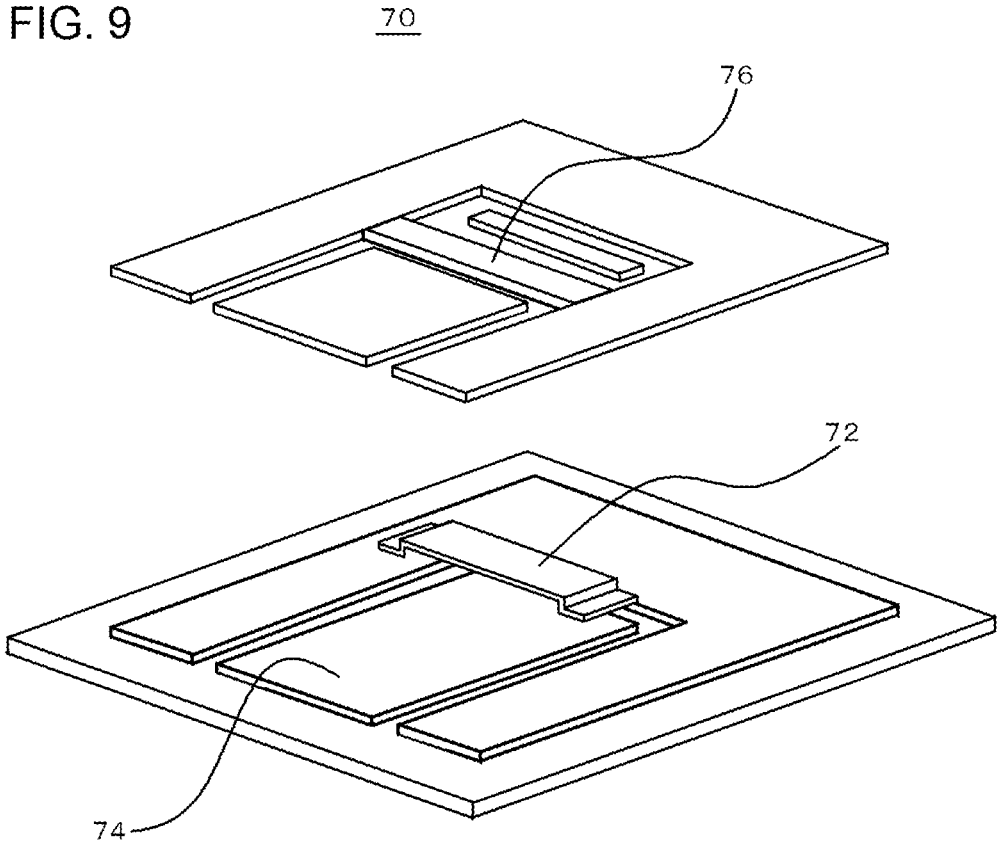
FIG. 9 is an exploded perspective view illustrating a configuration of an MEMS actuator that is used as a vibrator of an oscillator included in a portable terminal device as an audio output device according to a fifth embodiment.

The oscillator 31 of the portable terminal device 100 according to the embodiment includes an MEMS (Micro Electro Mechanical Systems) actuator 70 shown in FIG. 9, instead of the vibrator 33 (FIG. 3). In other respects, the portable terminal device 100 according to the embodiment is configured in a similar manner to the portable terminal devices 100 according to the first to fourth embodiments.

In an example shown in FIG. 9, a driving method of the MEMS actuator 70 is a piezoelectric method, and a piezoelectric thin layer 72 is interposed between an upper movable electrode layer 74 and a lower movable electrode layer 76. The MEMS actuator 70 is operated by inputting a signal to the upper movable electrode layer 74 and the lower movable electrode layer 76 from the signal generation unit 35. The MEMS actuator 70 is manufactured using, for example, an aerosol deposition method, but it is not limited thereto. When the aerosol deposition method is used, the piezoelectric thin layer 72, the upper movable electrode layer 74, and the lower movable electrode layer 76 can also be formed on a curved surface. For this reason, the aerosol deposition method is preferable. Meanwhile, the driving method of the MEMS actuator 70 may be an electrostatic method, electromagnetic method, or heat conduction method.

[Sixth Embodiment]

Figure 10:
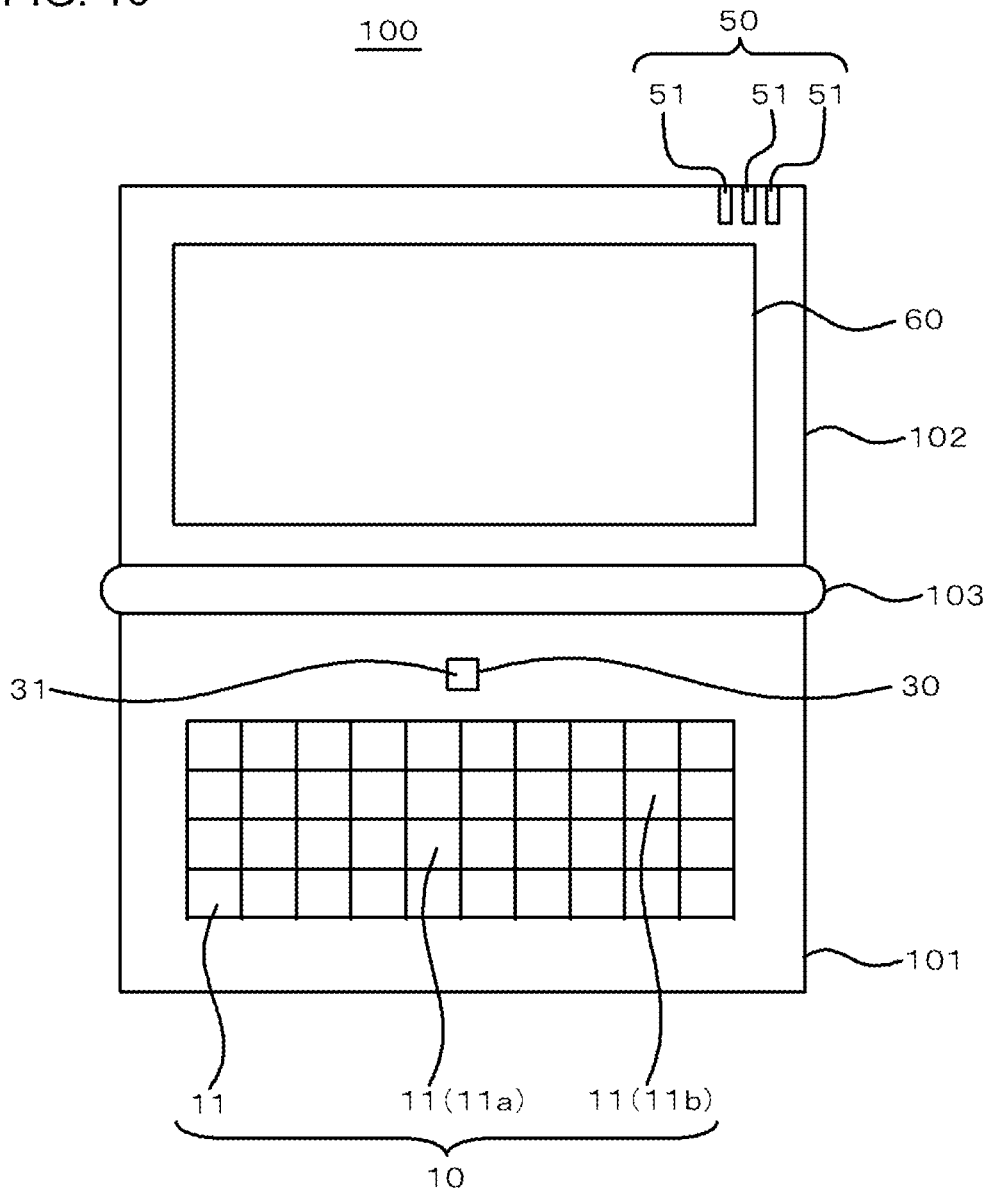
FIG. 10 is a front view illustrating a portable terminal device as an audio output device according to a sixth embodiment.
Figure 11:
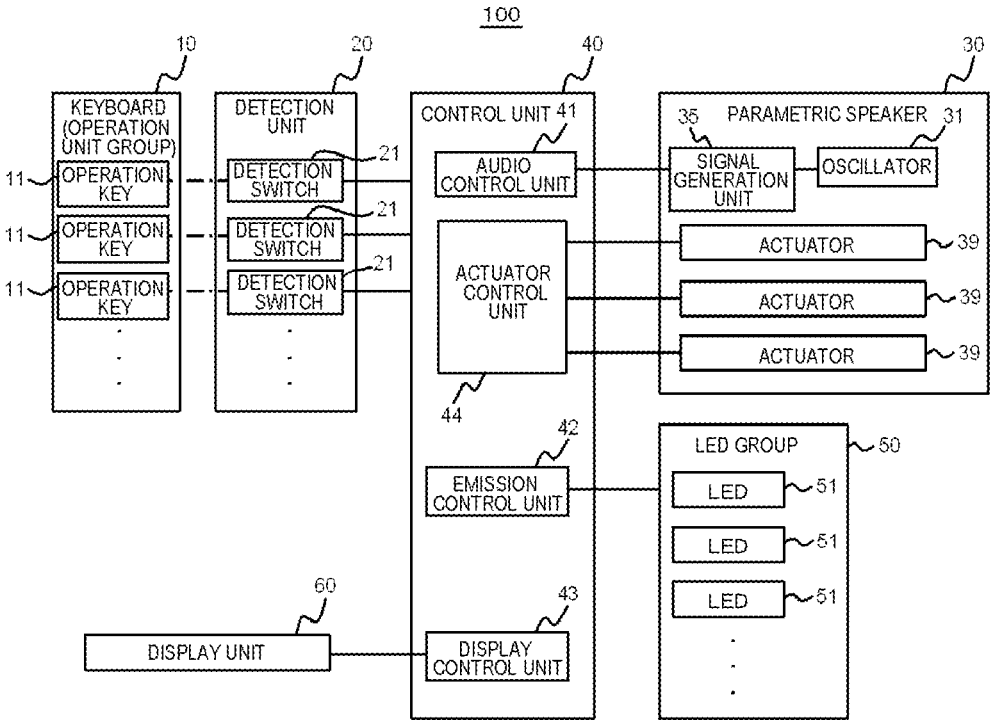
FIG. 11 is a block diagram illustrating the portable terminal device of FIG. 10.
Figure 12:
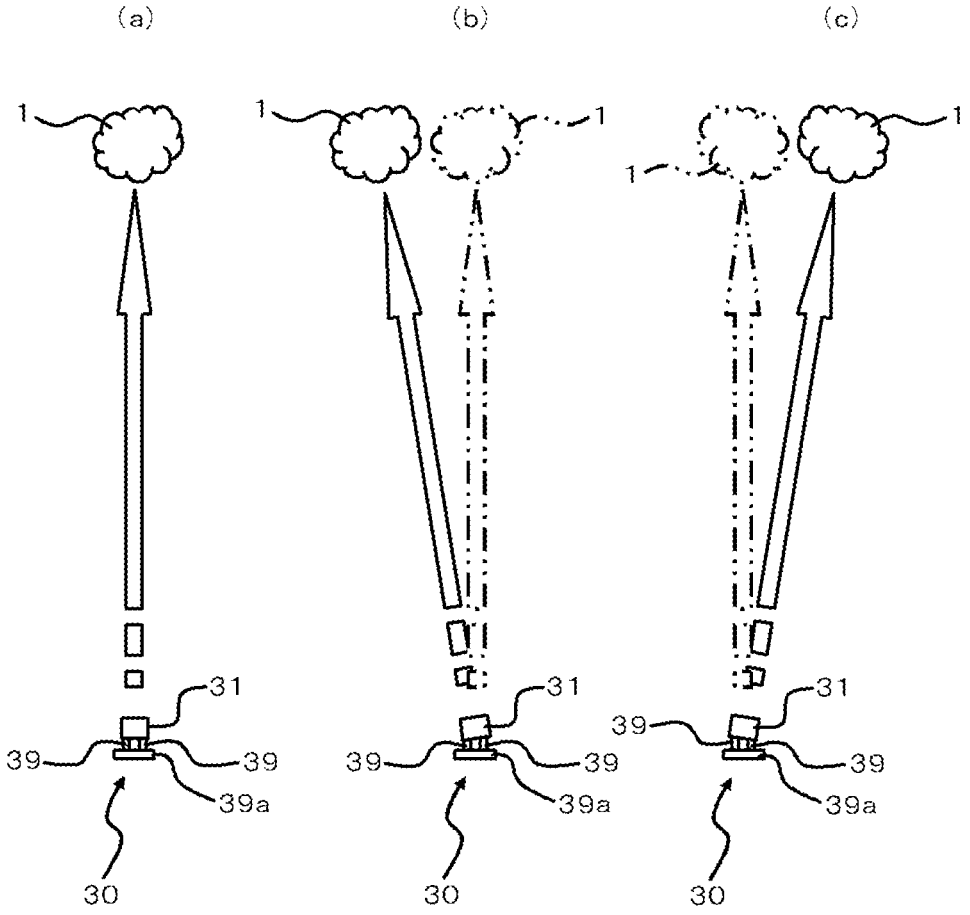
FIG. 12 is a schematic diagram illustrating operations for changing a position at which an audio image is formed according to the sixth embodiment.

FIG. 10 is a front view illustrating a portable terminal device 100 as an audio output device according to a sixth embodiment. FIG. 11 is a block diagram illustrating the portable terminal device 100 of FIG. 10. FIG. 12 is a schematic diagram illustrating operations for changing a position at which an audio image is formed according to the embodiment.

Each of the above-described embodiments shows an example in which a position at which the audio image is formed is controlled by controlling the phase of the ultrasonic waves output from each oscillator 31 of the parametric speaker 30.

On the other hand, in the embodiment, a direction in which acoustic waves are output from the oscillator 31 is changed using an actuator 39 so as to control the directionality of the parametric speaker 30 and to control the position at which the audio image is formed, that is, the position at which the audio sound is demodulated.

In the embodiment, the parametric speaker 30 includes, for example, a single (one) oscillator 31, a plurality of the actuators 39 for changing the direction of the oscillator 31, and a supporting unit 39*a* to which the actuators 39 are fixed.

The supporting unit 39*a* is directly or indirectly fixed to a housing (for example, the first housing 101) of the portable terminal device 100. The supporting unit 39*a* is formed, for example, in a flat plate shape.

The actuators 39 are, for example, piezoelectric elements, and expand and contract by controlling a voltage to be applied. One end of each actuator 39 is fixed to the supporting unit 39*a*, and the other end thereof is fixed to, for example, the supporting member 34 of the oscillator 31. For example, as shown in FIG. 12, the actuators 39 are provided so as to vertically stand up from one surface of the supporting unit 39*a*.

A number of actuators 39 can be set to two or three. When three actuators 39 are provided, a degree of freedom of the adjustment of the direction of the oscillator 31 increases. For this reason, in the embodiment, as shown in FIG. 11, it is preferable that the parametric speaker 30 have three actuators 39. The expansion and contraction operations of the actuators 39 are performed by an actuator control unit 44 (FIG. 11) of the control unit 40.

For the convenience of description, FIG. 12 shows operations when the parametric speaker 30 includes two actuators 39.

When the actuators 39 have the same length, the direction in which the ultrasonic waves are output from the oscillator 31 is set to be an opposite direction to the supporting unit 39*a* (in other words, the vibration member 32 of the oscillator 31 is parallel to the supporting unit 39*a*). Therefore, an audio image 1 is formed in the front direction of the supporting unit 39*a* (FIG. 12(*a*)).

In addition, any one actuator 39 is contracted (or any one actuator 39 is expanded), thereby allowing an angle of the oscillator 31 with respect to the supporting unit 39*a* to be changed and allowing the direction in which the ultrasonic waves are output from the oscillator 31 to be changed (in other words, allowing the vibration member 32 to be inclined with respect to the supporting unit 39*a*). Therefore, the audio image 1 is formed at a position that is offset from the front of the supporting unit 39*a* (FIG. 12(*b*), FIG. 12(*c*)).

Therefore, in the embodiment, the actuators 39 are appropriately expanded and contracted, thereby allowing the audio image 1 to be formed above the desired operation key 11 or above the desired LED 51.

According to the sixth embodiment, the same effects as the first embodiment are obtained.

In addition, in the sixth embodiment, since the position at which the audio image 1 is formed is changed by changing the direction in which the acoustic waves are output from the oscillator 31 using the actuators 39, the parametric speaker 30 does not need to include the plurality of oscillators 31 arranged in an array, and may include, for example, just a single oscillator 31.

Although each of the above-described embodiments shows an example that the direction in which an audio is heard is associated with the position of the operation unit which is disposed separately from the display unit 60, when the display unit 60 is a touch panel, the direction in which an audio is heard may be associated with the position of the operation unit formed in the display unit 60.

The application is based on Japanese Patent Application No. 2011-020330 filed on Feb. 2, 2011, the content of which is incorporated herein by reference.

The invention claimed is:

1. An audio output device comprising:

a plurality of operation units that are operated by a user;

a detection unit that detects which operation unit of the plurality of operation units is operated;

a directional speaker;

an audio control unit that controls the directional speaker so that an audio image is formed at a position corresponding to the position of the operation unit operated by the user among the plurality of operation units;

a light-emitting member; and an emission control unit that controls the light-emitting member, wherein the audio control unit controls the directional speaker so that the audio image is formed at a position corresponding to the position of the light-emitting member in association with the emission operation of the light-emitting member.

2. The audio output device according to claim 1, wherein the audio control unit controls the directional speaker so that an audio corresponding to the operation unit operated by the user is output.

3. The audio output device according to claim 1, wherein at least one of the plurality of operation units is an operation key.

4. The audio output device according to claim 1, wherein the directional speaker is a parametric speaker.

5. The audio output device according to claim l, further comprising a plurality of the light-emitting members which are arranged in a matrix, wherein the audio control unit controls the directional speaker so that the audio image is formed at the position corresponding to the position of the light-emitting member that emits light among the plurality of light-emitting members.

6. The audio output device according to claim 5, wherein the emission control unit performs a series of emission control operations for causing the plurality of light-emitting members to emit light in a predetermined order.

7. The audio output device according to claim 1, wherein the audio output device is a portable terminal device.

* * * * *